US007469636B2

(12) United States Patent
Dilling et al.

(10) Patent No.: US 7,469,636 B2
(45) Date of Patent: Dec. 30, 2008

(54) PRINTING UNIT FOR A PRESS

(75) Inventors: Peer Dilling, Friedberg (DE); Godber Petersen, Augsburg (DE); Josef Schneider, Diedorf (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 0 days.

(21) Appl. No.: 11/222,719

(22) Filed: Sep. 9, 2005

(65) Prior Publication Data

US 2006/0054041 A1 Mar. 16, 2006

(30) Foreign Application Priority Data

Sep. 9, 2004 (DE) ..... 10 2004 043 503

(51) Int. Cl.
*B41F 7/02* (2006.01)

(52) U.S. Cl. ..... 101/142; 101/451; 101/463.1; 101/478; 101/DIG. 49

(58) Field of Classification Search ..... 101/142
See application file for complete search history.

(56) References Cited

U.S. PATENT DOCUMENTS 5,909,708 A 6/1999 Bolza-Schünemann
5,934,196 A * 8/1999 Korem ..... 101/467
6,510,795 B1 * 1/2003 Detmers et al. ..... 101/480

FOREIGN PATENT DOCUMENTS

DE 101 21 827 A1 12/2002
DE 102 21 330 A1 12/2002

OTHER PUBLICATIONS

"Handbuch der Printmedien [Handbook of print media]", Helmut Kipphan, pp. 604-611(w/English translation thereof).
Helmut Kipphan, "Handbuch der Printmedien", 2000, pp. 674-680, Springer-Verlag.

* cited by examiner

*Primary Examiner*—Leslie J. Evanisko
*Assistant Examiner*—Joshua Zimmerman
(74) *Attorney, Agent, or Firm*—Crowell & Moring LLP

(57) ABSTRACT

A printing unit having at least one press unit, the, or each, press unit having at least one form cylinder, a transfer cylinder, an inking unit and preferably a damping unit, and having at least one imaging device for imaging and/or de-imaging a rewritable and erasable printing form positioned on the form cylinder. The inking unit, if appropriate together with the damping unit, can be pivoted with respect to a form cylinder from a printing position into a rest position. The imaging device can be pivoted with respect to the form cylinder from an imaging position into a rest position. The imaging device is pivoted into a rest position when the inking unit and, if appropriate, damping unit is pivoted into the printing position and, when the imaging device is pivoted into the imaging position, the inking unit and, if appropriate, the damping unit is pivoted into a rest position.

12 Claims, 5 Drawing Sheets

PRINTING UNIT FOR A PRESS

This application claims the priority of German Patent Document No. 10 2004 043 503.0, filed Sep. 9, 2004, the disclosure of which is expressly incorporated by reference herein.

BACKGROUND AND SUMMARY OF THE INVENTION

The invention relates to a printing unit for a press.

Printing units of web-fed rotary presses, in particular of newspaper presses, have a plurality of press units, each press unit comprising a transfer cylinder, a form cylinder and an inking unit and damping unit. Furthermore, such printing units can have impression cylinders, it being possible for an impression cylinder to interact with one or more transfer cylinders of different press units. In addition to printing units which have such impression cylinders, printing units which have no impression cylinder are also known, the transfer cylinders of two press units rolling on each other in such printing units without impression cylinders. The transfer cylinders are also designated blanket cylinders, and the form cylinders are also designated plate cylinders. The form cylinders or plate cylinders bear printing forms.

When printing with a printing form, a distinction is in principle drawn between methods which, on the one hand, operate with a printing form which can be written once and, on the other hand, operate with a rewritable printing form. Printing methods which use rewritable printing forms are also summarized under the keyword "computer to press/direct imaging". The present invention relates to a printing unit for a press which operates with rewritable and erasable printing forms. The applicant markets digital presses which operate with rewritable and erasable printing forms, under the product description "DICOweb".

The principles of the DICOweb technology are described in "Handbuch der Printmedien [Handbook of print media], Helmut Kipphan, pages 674 to 680, year 2000, Springer-Verlag". Printing units which operate with such rewritable and erasable printing forms have, in addition to the subassemblies described above, at least one imaging device for imaging and/or de-imaging the rewritable and erasable printing forms positioned on the form cylinders.

Press units of web-fed rotary presses are increasingly being designed more compactly, that is to say with smaller dimensions. As a result, the overall room available on the printing units of a press is reduced, that is to say the space available for positioning and arranging the inking units, damping units and imaging devices. Furthermore, in the case of printing units having compact designs, access to the cylinders, specifically to the form cylinders and transfer cylinders, is made more difficult. In the case of printing units having small dimensions, the integration of inking units, damping units and imaging devices into the press while simultaneously ensuring simple access to the form cylinders and transfer cylinders of the printing units is already presenting considerable difficulties.

On this basis, the present invention is based on the problem of providing a novel type of printing unit for a press.

According to an embodiment of the invention, the inking unit, if appropriate together with the damping unit, can be pivoted with respect to a preferably fixed form cylinder from a printing position into a rest position, it being possible for the imaging device to be pivoted with respect to the preferably fixed form cylinder from an imaging position into a rest position, the imaging device being pivoted into a rest position when the inking unit and, if appropriate, damping unit is pivoted into the printing position and, when the imaging device is pivoted into the imaging position, the inking unit and, if appropriate, the damping unit being pivoted into a rest position. It is also possible for the inking unit and, if appropriate, the damping unit and also the imaging device to be pivoted into the respective rest position, simple access to the cylinders of the printing unit then being ensured.

In an alternative embodiment of a press unit according to the invention, by means of a translational relative movement between the form cylinder of each print unit and the corresponding imaging device, which movement runs in the direction of the longitudinal axis of the form cylinders, the respective press unit can be transferred from printing operation to imaging operation.

Both embodiments of the invention ensure simple integration of inking units, damping units and imaging devices in printing units of presses having compact designs. By means of translational or pivoting movements between the form cylinders and inking unit, damping unit and the imaging devices, the overall space available may be utilized optimally and, furthermore, simple access to the cylinders of the printing unit is ensured. In the sense of the present invention, either the, or each, imaging device can be moved toward the respective form cylinders of the printing unit or, on the other hand, the form cylinders can also be moved towards the, or each, imaging device. In this case, as mentioned, either translational or pivoting movements are utilized.

BRIEF DESCRIPTION OF THE DRAWINGS

Preferred developments of the invention emerge from the following description. Exemplary embodiments of the invention will be explained in detail, without being restricted thereto, by using the drawings, as described below.

DETAILED DESCRIPTION OF THE DRAWINGS

In the following text, the present invention will be described in greater detail with reference to FIGS. 1 to 6.

Figure 1:
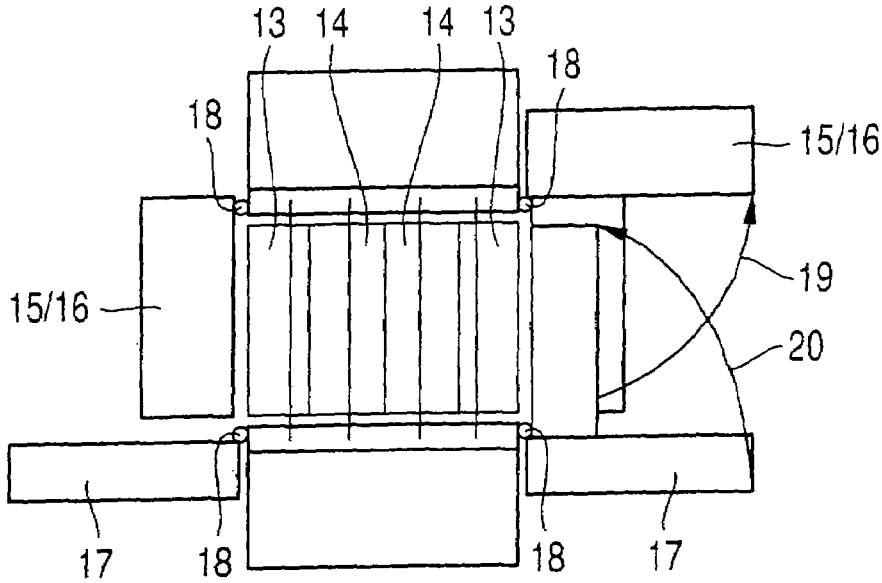
FIG. 1 shows a schematic plan view of a printing unit according to the invention according to a first exemplary embodiment of the invention.
Figure 2:
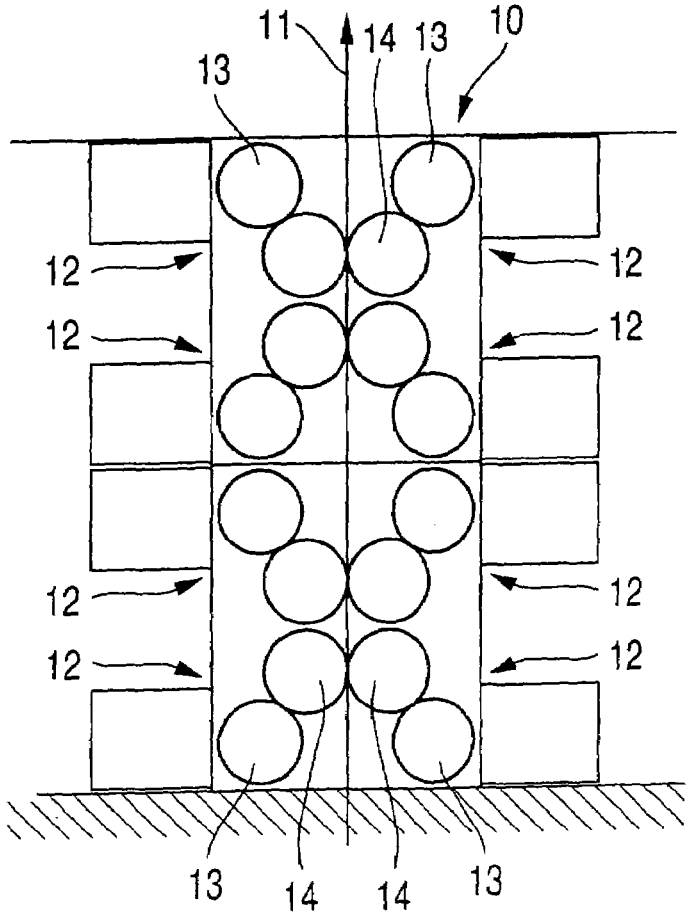
FIG. 2 shows the printing unit of FIG. 1 in a schematic side view.
Figure 3:
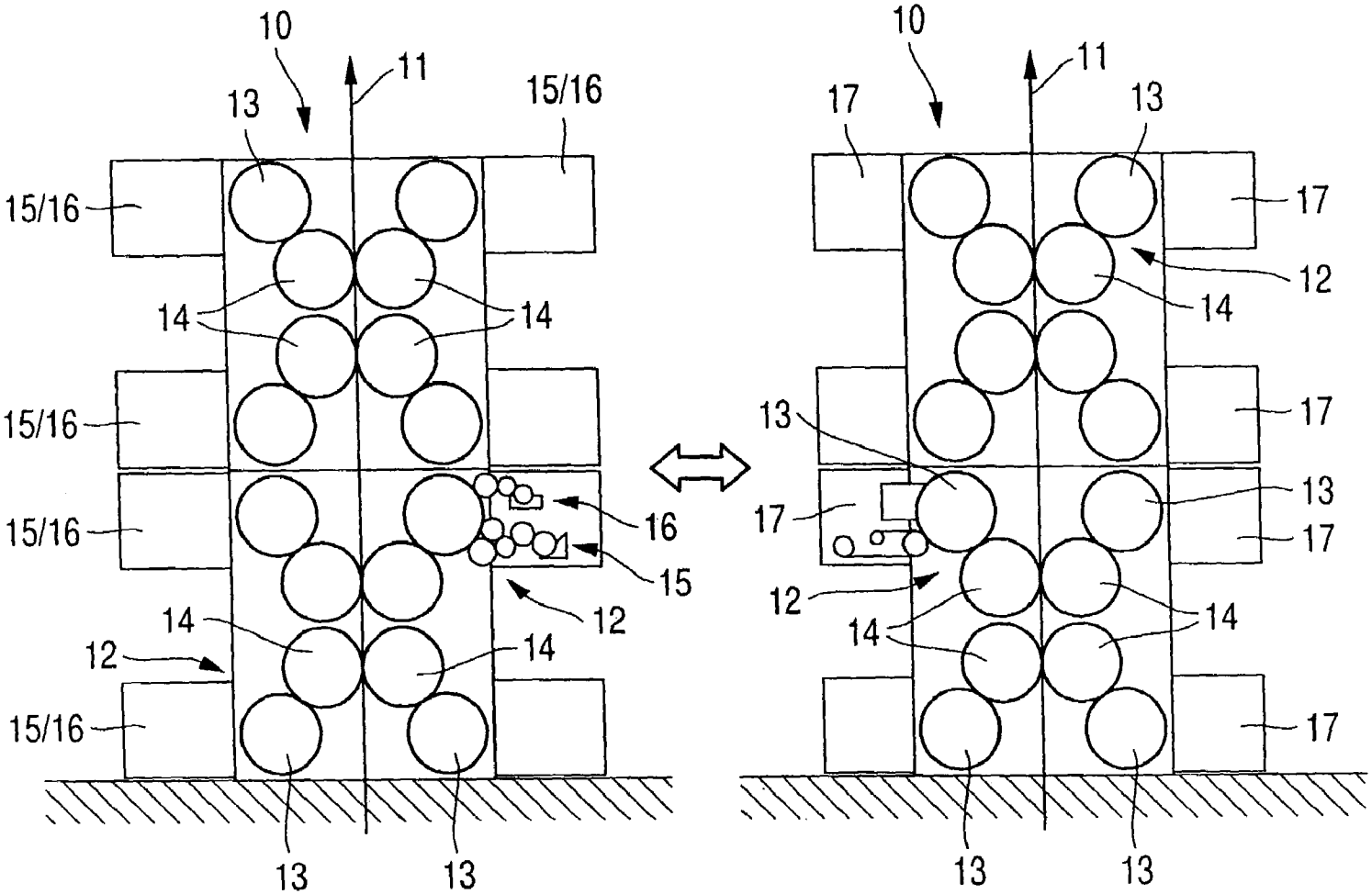
FIG. 3 shows the printing unit of FIG. 2 doing printing operation and in imaging operation.

FIGS. 1 to 3 show a first exemplary embodiment of the present invention using the example of a printing unit 10 of a web-fed rotary press with a vertical web run. The web run of the printing material through the printing unit 10 in FIGS. 2 and 3 is visualized by arrows 11.

In the exemplary embodiment of FIGS. 1 to 3, the printing unit 10 has a total of eight press units 12, each of the press units 12 having a form cylinder 13 and a transfer cylinder 14. Rewritable and erasable printing forms are positioned on the form cylinders 13; the printing unit 10 is accordingly designed as what is known as a "computer to press/direct imaging" printing unit. The form cylinders 13 are also designated plate cylinders. As a rule, rubber blankets are positioned on the transfer cylinders 14, for which reason the transfer cylinders 14 are also designated rubber-covered cylinders. It can be gathered from FIG. 2 that in each case two transfer cylinders 14 of two press units 12 roll on each other and print both sides of the printing material moved through the printing unit 10 in the vertical direction in the direction of the arrow 11.

In addition to the form cylinders 13 and transfer cylinders 14, each printing unit 12 in the exemplary embodiment of FIGS. 1 to 3 is assigned an inking unit, a damping unit and an imaging device. The inking unit and damping unit are used to apply printing ink and damping solution to a printing form positioned on the form cylinder 13 of a press unit 12. The imaging devices are used for de-imaging or erasing and imaging the printing forms positioned on the form cylinders. FIG. 3 shows, in the left-hand half, as an example of a press unit 12, an inking unit 15 interacting with the form cylinder 13 of the press unit 12 and a damping unit 16 interacting with the same. For the other press units 12 of the printing unit 10, on the left-hand side of FIG. 3 the inking unit 15 and damping unit 16 are merely illustrated as simple boxes. On the right-hand side of FIG. 3, for a press unit 12, an imaging device 17 interacting with the form cylinder 13 of the same is illustrated, the imaging devices 17 for the remaining press units 12 again being illustrated as simple boxes on the right-hand side of FIG. 3. In the left-hand illustration of FIG. 3, in which the inking units 15 and the damping units 16 are set against the form cylinders 13 of the press units 12, the printing unit 10 is accordingly in printing operation. In the state which is illustrated on the right-hand side of FIG. 3 and in which the imaging devices 17 are set against the form cylinders 13 of the press units 12, the printing units 10 are in imaging operation.

In order to integrate inking units 15, damping units 16 and imaging devices 17 into the printing units 10 despite the small amount of space available in such printing units 10 and, furthermore, to ensure simple access to the cylinders 13 and 14 of the printing units 10 for maintenance work in particular, in the sense of a first aspect of the present invention it is proposed to construct the inking unit 15 and the damping unit 16, on the one hand, and the imaging device 17, on the other hand, of each press unit 12 such that it can be pivoted.

Thus, FIG. 1 shows that both the inking unit 15 together with the damping unit 16 and the imaging unit 17 of each press unit 12 can be pivoted in a horizontal plane about pivot axes 18. On the left-hand side of FIG. 1, the inking unit 15 and the damping unit 16 are pivoted against the form cylinder 13 of a press unit 12, and are accordingly in the printing position. The imaging device 17, on the other hand, has been pivoted away from the form cylinder 13 and pivoted into a rest position. Depending on whether the press units 12 of the printing unit 10 are to be operated in imaging operation or in printing operation, the inking unit 15 together with the damping unit 16 can be pivoted relative to the fixed form cylinder 13 of the respective press unit 12, namely between a rest position and a printing position. Furthermore, the imaging unit 17 can be pivoted between a rest position and an imaging position. The pivoting movements of the inking units 15 and damping units 16 and of the imaging devices 17 are visualized in FIG. 1 on the right-hand side by arrows 19 and 20. The arrow 19 visualizes the pivoting movement of the inking unit 15 and damping unit 16, the arrow 20, on the other hand, visualizes the pivoting movement of the imaging device 17. When the inking units 15 and damping units 16 are pivoted into the printing position, the imaging devices 17 are pivoted into the rest position. When the imaging devices 17 are pivoted into the imaging position, on the other hand, inking units 15 and damping units 16 are pivoted into the corresponding rest positions. By means of the above-described ability of the inking units 15, damping units 16 and imaging devices 17 to pivot horizontally, even in the case of compactly designed printing units 10, simple integration of inking unit 15, damping unit 16 and imaging device 17 into the printing unit 10 is possible. If both the inking units 15 and the damping units 16 and also the imaging devices 17 are pivoted into the rest position, then the form cylinders 13 and the transfer cylinders 14. are easily accessible.

In the exemplary embodiment of FIGS. 1 to 3, for each press unit 12 individually or separately, the corresponding inking unit 15 and the corresponding damping unit 16 and the corresponding imaging device 17 can be pivoted relative to the fixed form cylinder 13 of the press unit 12. The pivotable inking unit 15 and damping unit 16 are in this case constructed as individually driven units.

Figure 4:
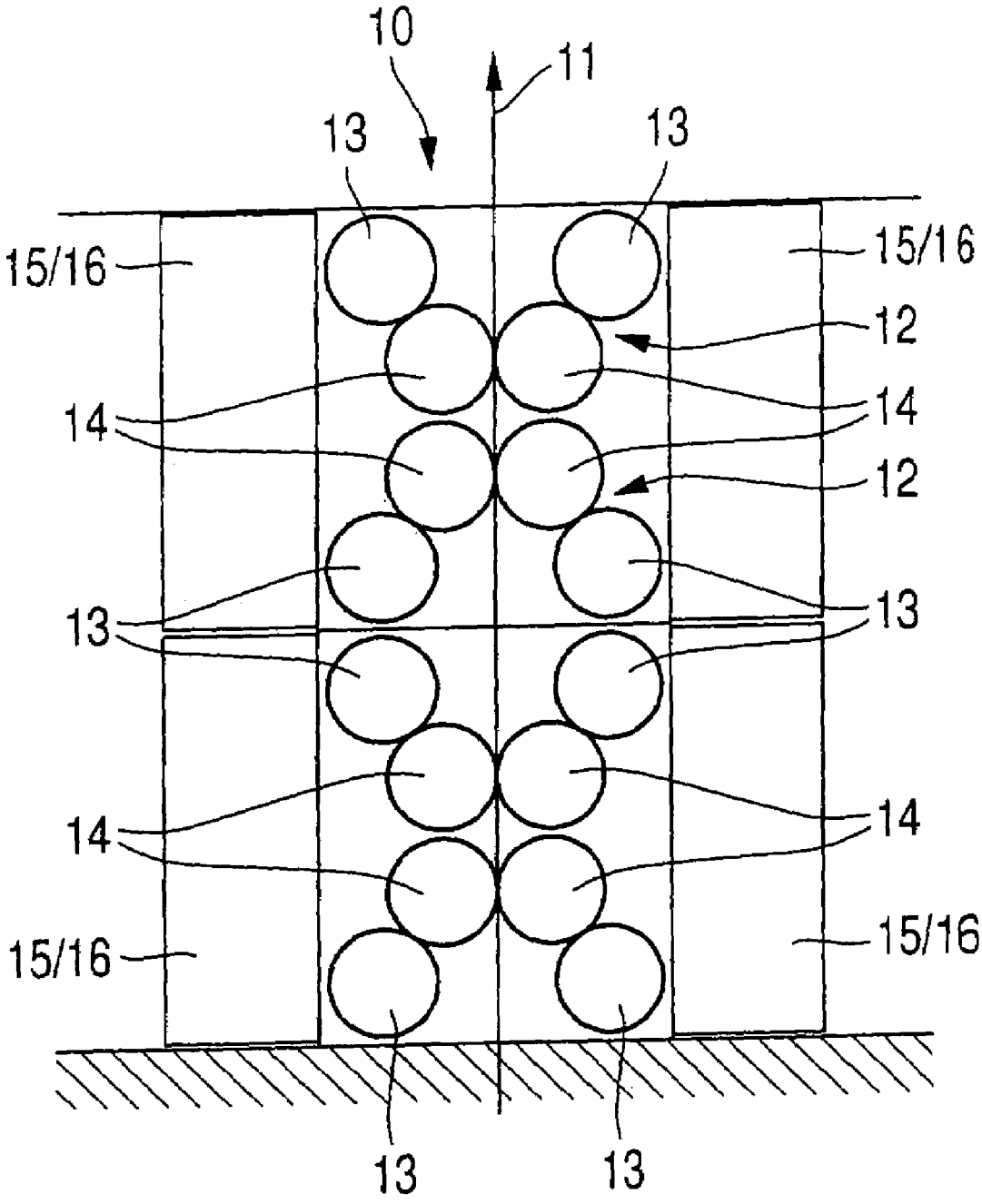
FIG. 4 shows a schematic side view of a printing unit according to the invention according to a second exemplary embodiment of the invention.

In the exemplary embodiment of FIG. 4, as distinct from the exemplary embodiment of FIGS. 1 to 3, the inking unit 15, damping unit 16 and the imaging device 17 for each press unit 12 cannot be pivoted separately in the horizontal plane but, instead, in the exemplary embodiment of FIG. 4, the above subassemblies for two press units 12 can in each case can be pivoted together. It is also conceivable to join these subassemblies together to form larger modules and, accordingly, to pivot them together for three or else four press units. Since, with regard to the remaining details, the exemplary embodiment of FIG. 4 agrees with the exemplary embodiment of FIGS. 1 to 3, the same reference numbers are used here for the same subassemblies in order to avoid unnecessary repetitions, and reference is made to the explanations relating to the exemplary embodiment of FIGS. 1 to 3.

The common factor in the two exemplary embodiments according to FIGS. 1 to 4 is that the easy integration of the inking unit 15, damping unit 16 and imaging device 17 into one printing unit of compact design, and also the easy accessibility of the cylinders 13 and 14 of the printing units 10 is implemented by means of pivoting movements of the inking unit 15 and damping unit 16, one the one hand, and of the imaging device 17, on the other hand. In the following text, with reference to FIGS. 5 and 6, two exemplary embodiments will be described in which this is implemented by means of a translational relative movement between the form cylinders of the press units and the corresponding imaging device, the relative movement between the form cylinders and the corresponding imaging device running in the direction of a longitudinal axis of the form cylinders.

Figure 5:
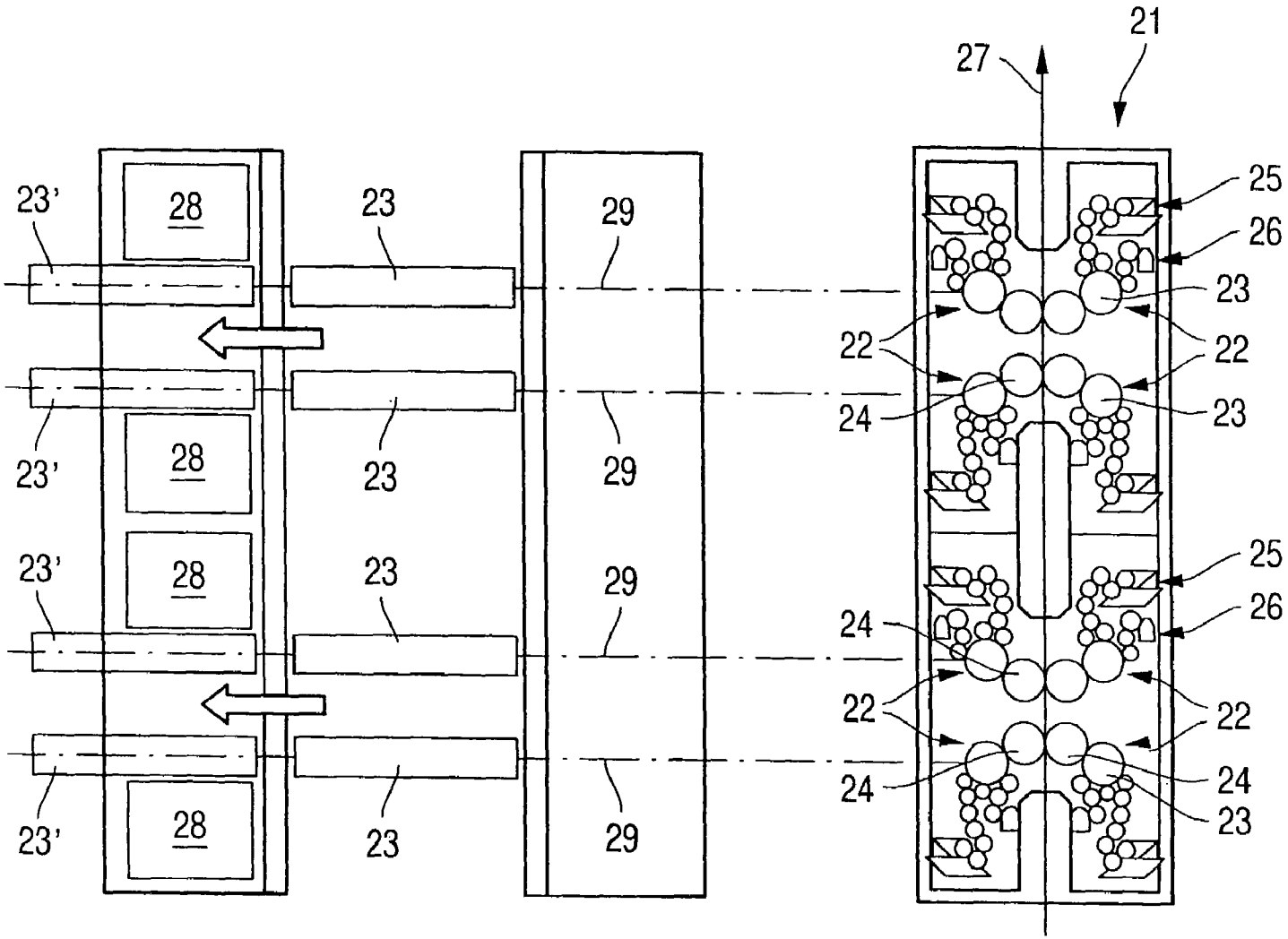
FIG. 5 shows a schematic view of a printing unit according to the invention according to a third exemplary embodiment of the invention.

FIG. 5 shows a printing unit 21 of a web-fed rotary press, which again has a total of eight press units 22, each of the press units 22 again comprising a form cylinder 23, a transfer cylinder 24, an inking unit 25 and a damping unit 26. The web run of the printing material through the printing unit 21 is again visualized by means of an arrow 27. In the exemplary embodiment of FIG. 5, the transfer cylinders 24, the inking units 25 and the damping units 26 of each press unit 22, and also the imaging devices 28, interacting with the press units 22 are all designed to be fixed. The form cylinders 23 can, by contrast, be moved in the direction of a longitudinal central axis 29 of the same. As can be gathered from the left-hand side of FIG. 5, the form cylinders 23 can be moved between a printing position, identified by the reference number 23, and an imaging position, identified by the reference number 23'. Each of the form cylinders 23 which can be moved translationally is designed such that it can be moved translationally independently of the other form cylinders and as an individually driven cylinder.

Figure 6:
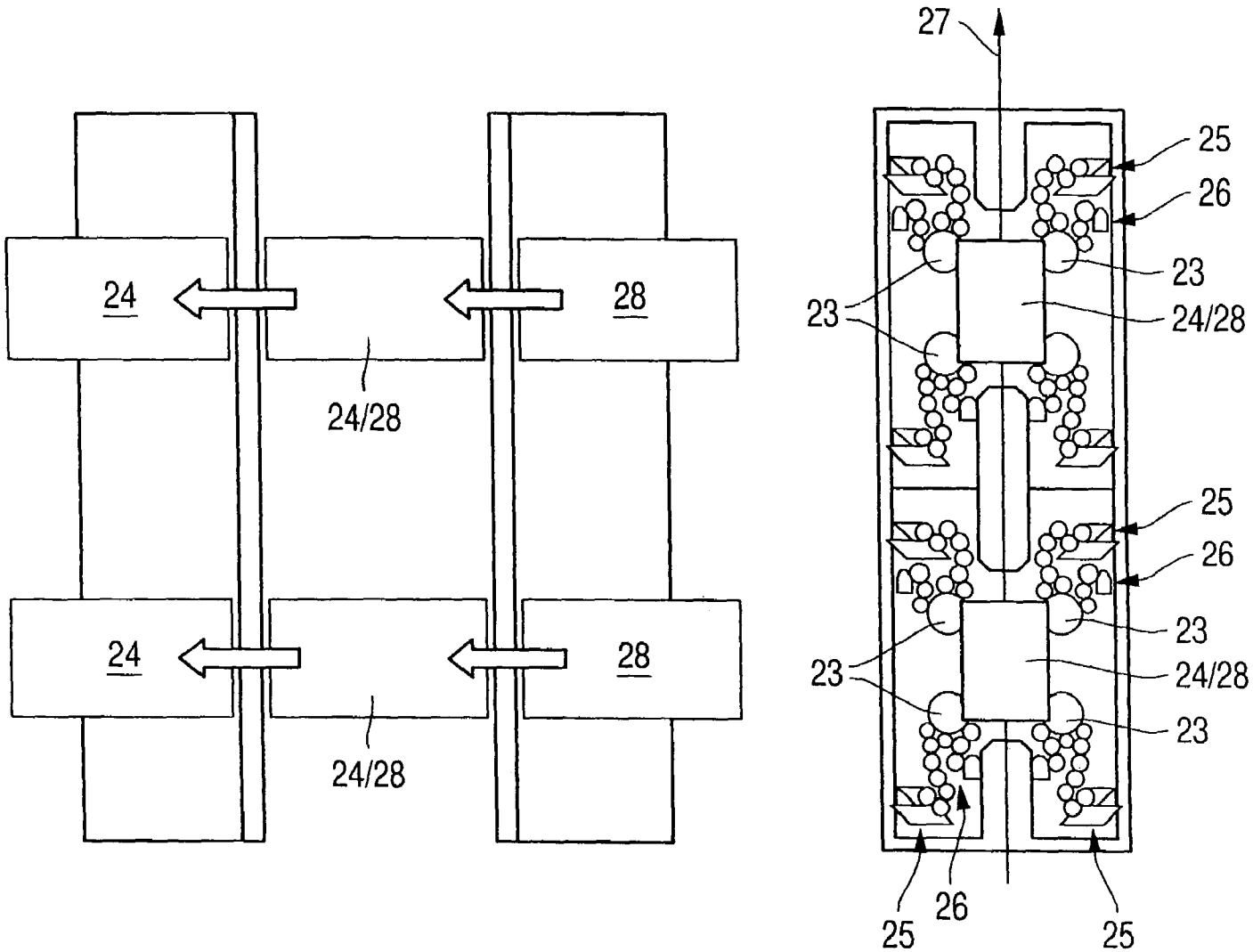
FIG. 6 shows a schematic view of a printing unit according to the invention according to a further exemplary embodiment of the invention.

As distinct from the exemplary embodiment of FIG. 5, in the exemplary embodiment of FIG. 6 the form cylinders 23 are designed to be fixed. By contrast, on the other hand, the imaging device 28 and the transfer cylinder 24 can be moved in the translational direction, specifically once more in the direction of the longitudinal central axis of the form cylinders 23. Thus, it can be gathered from FIG. 6 that, in this exemplary embodiment, the transfer cylinders 24 of four press units 22 can be moved together from a printing position into a rest position. In the space then released by the transfer cylinders 24 within the press units, the imaging units 28 can then be moved translationally, in order to then, in this imaging position, image the form cylinders 23 of the press units. When the transfer cylinders 24 are moved into the printing position, the imaging devices 28 are accordingly moved into their rest position; when the imaging devices 28 are moved into the imaging position, the transfer cylinders are moved into corresponding rest positions. In the exemplary embodiment of FIG. 6, too, the change between printing operation and imaging operation is also established by means of a translational relative movement between the imaging devices 28 and the respective form cylinders 23.

With reference to FIGS. 1 to 6, the present invention has been described by using the example of web-fed rotary presses with vertical web guidance. It should be pointed out that the invention can of course also be used in web-fed rotary presses with horizontal web guidance. Likewise, the invention can be used in printing units whose transfer cylinders roll on what are known as impression cylinders.

LIST OF REFERENCE SYMBOLS

10 Printing unit
11 Direction of movement
12 Press unit
13 Form cylinder
14 Transfer cylinder
15 Inking unit
16 Damping unit
17 Imaging device
18 Pivot point
19 Direction of movement
20 Direction of movement
21 Printing unit
22 Press unit
23 Form cylinder
24 Transfer cylinder
25 Inking unit
26 Damping unit
27 Direction of movement
28 Imaging device
29 Longitudinal central axis The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A printing unit having at least one press unit, the press unit having at least one form cylinder, a transfer cylinder, an inking unit and a damping unit, and having at least one imaging device for imaging and/or de-imaging a rewritable and erasable printing form positioned on the form cylinder;

wherein the inking unit and the damping unit are pivotable with respect to the form cylinder between an operational printing position where the inking unit and the damping unit are positioned in an operating position space adjacent to the form cylinder, wherein a footprint of the operating position space of the inking unit is substantially identical to a footprint of the operating position space of the imaging device, and a rest position where the inking unit and the damping unit are removed from the operating position space;

wherein the imaging device is pivotable with respect to the form cylinder between an operational imaging position where the imaging device is positioned in the operating position space adjacent to the form cylinder and a rest position where the imaging device is removed from the operating position space; and wherein the imaging device is removed from the operating position space when the inking unit and damping unit are positioned in the operating position space and the imaging device is positioned in the operating position space when the inking unit and the damping unit are removed from the operating position space.

2. The printing unit according to claim 1, wherein the form cylinder of the press unit is fixed.

3. The printing unit according to claim 2, wherein the inking unit, the damping unit, and the imaging device are mounted such that they are pivotable laterally beside the fixed form cylinder.

4. The printing unit according to claim 1, wherein the inking unit, the damping unit, and the imaging unit are pivotable in a horizontal plane.

5. The printing unit according to claim 1, wherein a pivoting movement of the inking unit and the damping unit, and imaging device, for each press unit or each form cylinder is carried out individually or jointly.

6. The printing unit according to claim 1, wherein the pivotable inking unit and damping unit are driven individually.

7. A printing unit, comprising:

a press unit, the press unit having:

a form cylinder;

a transfer cylinder;

an inking unit;

a damping unit; and an imaging device;

wherein the inking unit and the damping unit are pivotable with respect to the form cylinder between an operational printing position where the inking unit and the damping unit are positioned in an operating position space adjacent to the form cylinder, wherein a footprint of the operating position space of the inking unit is substantially identical to a footprint of the operating position space of the imaging device, and a rest position where the inking unit and the damping unit are removed from the operating position space;

and wherein the imaging device is pivotable with respect to the form cylinder between an operational imaging position where the imaging device is positioned in the operating position space adjacent to the form cylinder and a rest position where the imaging device is removed from the operating position space.

8. The printing unit according to claim 7, wherein the imaging device is removed from the operating position space when the inking unit and damping unit are positioned in the operating position space and wherein the imaging device is positioned in the operating position space when the inking unit and the damping unit are removed from the operating position space.

9. The printing unit according to claim 7, wherein the form cylinder of the press unit is fixed.

10. The printing unit according to claim 9, wherein the inking unit, the damping unit, and the imaging device are mounted such that they are pivotable laterally beside the fixed form cylinder.

11. The printing unit according to claim 7, wherein the inking unit, the damping unit, and the imaging unit are pivotable in a horizontal plane.

12. The printing unit according to claim 7, wherein the pivotable inking unit and damping unit are driven individually.

* * * * *